US008838301B2

(12) United States Patent
Makkinejad

(10) Patent No.: US 8,838,301 B2
(45) Date of Patent: Sep. 16, 2014

(54) TRAIN TRAFFIC ADVISOR SYSTEM AND METHOD THEREOF

(75) Inventor: Babak Makkinejad, Troy, MI (US)

(73) Assignee: Hewlett-Packard Development Company, L. P., Houston, TX (US)

( * ) Notice: Subject to any disclaimer, the term of this patent is extended or adjusted under 35 U.S.C. 154(b) by 222 days.

(21) Appl. No.: 13/456,784

(22) Filed: Apr. 26, 2012

(65) Prior Publication Data

US 2013/0289805 A1 Oct. 31, 2013

(51) Int. Cl.
*G05D 1/00* (2006.01)

(52) U.S. Cl.
USPC ..... 701/19; 246/3

(58) Field of Classification Search
CPC ..... B61L 2205/04
USPC ..... 701/19, 117; 246/3, 473.1, 293
See application file for complete search history.

(56) References Cited

U.S. PATENT DOCUMENTS

| | | | | |
|---|---|---|---|---|
| 5,709,488 | A | 1/1998 | Imai | |
| 6,179,252 | B1 * | 1/2001 | Roop et al. | 246/293 |
| 7,447,571 | B2 | 11/2008 | Nickles et al. | |
| 7,734,383 | B2 | 6/2010 | Philp et al. | |
| 7,772,996 | B2 | 8/2010 | Burns | |
| 7,822,491 | B2 | 10/2010 | Howlett et al. | |
| 2004/0015275 | A1 * | 1/2004 | Herzog et al. | 701/19 |
| 2009/0109058 | A1 | 4/2009 | Kim et al. | |
| 2011/0084176 | A1 | 4/2011 | Reichelt et al. | |
| 2011/0095139 | A1 | 4/2011 | O'Dell | |

FOREIGN PATENT DOCUMENTS

| | | | |
|---|---|---|---|
| JP | 10016780 | A | 1/1998 |
| JP | 2011105117 | A | 6/2011 |

* cited by examiner

*Primary Examiner* — Thomas G Black
*Assistant Examiner* — Luke Huynh

(57) ABSTRACT

Embodiments of the present invention disclose a method and system for providing train traffic advice. According to one embodiment, train status information associated with at least one train is received at a data center hosting a train traffic advisor application. Train crossing location data is stored in a database and retrieved by the train traffic advisor application. Based on the received train status information and the train crossing location data, train traffic information associated with the at least one train is calculated. Subscribing devices are identified by the train traffic advisor application, and the train traffic information is communicated to at least one of the identified subscribing devices.

18 Claims, 6 Drawing Sheets

TRAIN TRAFFIC ADVISOR SYSTEM AND METHOD THEREOF

BACKGROUND

Despite the ubiquitous presence of automobiles and airplanes, railway trains still remain an important means of transportation for both passengers and cargo. Each day thousands of trains travel across diverse routes and some over great distances along railroad tracks. While traveling these routes, trains may encounter numerous railroad crossings, or junctions where the railroad tracks intersect a roadway. In most cases, flashing lights, boom barriers, and other warning systems/devices are used to notify vehicles and pedestrians of approaching trains at a particular railroad crossing. However, the approximate arrival time of train and the approximate duration for clearing these railroad crossings are not readily known in advance such that emergency, security, freight, passenger and other vehicles may plan alternate travel routes.

BRIEF DESCRIPTION OF THE DRAWINGS

The features and advantages of the inventions as well as additional features and advantages thereof will be more clearly understood hereinafter as a result of a detailed description of particular embodiments of the invention when taken in conjunction with the following drawings in which.

DETAILED DESCRIPTION OF THE INVENTION

Figure 1:
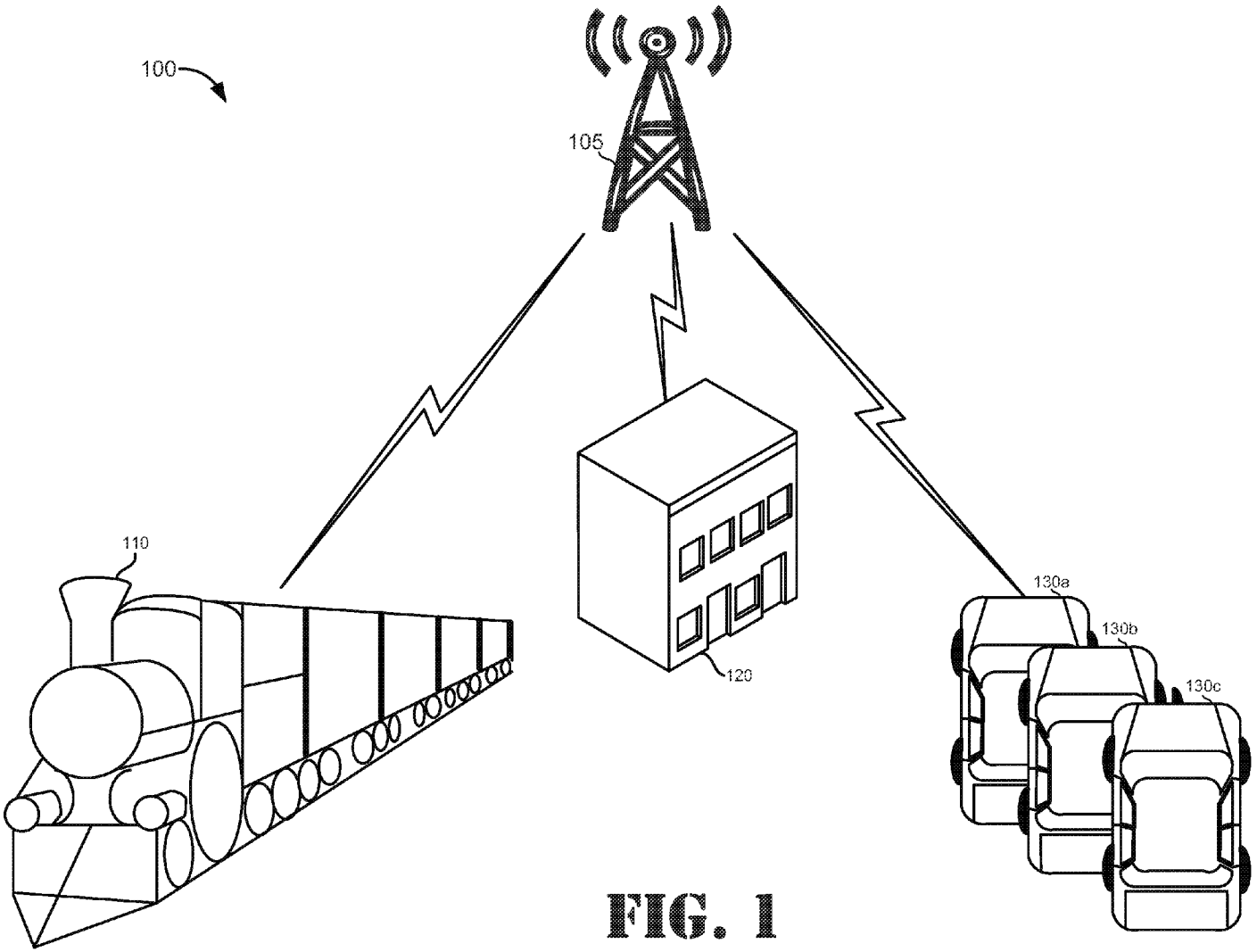
FIG. 1 is a simplified illustration of the train traffic advising system according to an example of the present invention.

The following discussion is directed to various embodiments. Although one or more of these embodiments may be discussed in detail, the embodiments disclosed should not be interpreted, or otherwise used, as limiting the scope of the disclosure, including the claims. In addition, one skilled in the art will understand that the following description has broad application, and the discussion of any embodiment is meant only to be an example of that embodiment, and not intended to intimate that the scope of the disclosure, including the claims, is limited to that embodiment. Furthermore, as used herein, the designators "A", "B" and "N" particularly with respect to the reference numerals in the drawings, indicate that a number of the particular feature so designated can be included with examples of the present disclosure. The designators can represent the same or different numbers of the particular features.

The figures herein follow a numbering convention in which the first digit or digits correspond to the drawing figure number and the remaining digits identify an element or component in the drawing. Similar elements or components between different figures may be identified by the user of similar digits. For example, 143 may reference element "43" in FIG. 1, and a similar element may be referenced as 243 in FIG. 2. Elements shown in the various figures herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense.

Some prior solutions provide a method for analyzing and determining the arrival time of a train at future passenger or freight drop-off and pickup destinations. However, these solutions are primarily directed towards various train stoppage and/or unload points rather than non-stop roadway intersection positions, and also does not account for the length of the train in determining the estimated time for clearing a particular traffic intersection. Still other solutions disclose a method for directly communicating data to suitably-equipped rail-road crossing devices which are configured to display the train arrival information through use of flashing lights and other display means so as to visually alert nearby pedestrians and motorists of a time-interval during which it is safe to cross the rail-road crossing. However, there remains a need in the art to make available the estimated arrival time of trains at railroad crossings and the length of time it will take each train to pass through these crossings to a wider audience so that such information may be taken into account when planning trips.

Examples of the present invention disclose a train traffic advising system and method thereof. According to one example embodiment, the train traffic advising system includes a train configured to communicate with a train traffic advisor application hosted by a data center. More particularly, the train traffic advisor is configured to collect train data—continuously and for a plurality of trains—in a data center and then to communicate train traffic information to various clients or subscribers of that data. As a result, motorists and pedestrians alike can utilize examples of the present invention in order to avoid identified train traffic hazards and help ease the flow of traffic along busy roadways and intersections.

Referring now in more detail to the drawings in which like numerals identify corresponding parts throughout the views, FIG. 1 is a simplified illustration of the train traffic advising system according to an example of the present invention. As shown here, the train traffic advising system 100 includes a communication device 105, a train or plurality of trains 110, a data center 120, and a plurality of subscriber devices 130*a*-130*c*. The communication device 105 represents a wireless transmission device for facilitating telecommunication between the data center 120, train 110, and subscribers 130*a*-130*c* and may include a telecommunication satellite, cellular telephone tower, and the like. As used herein, train 110 represents a railway or railroad train having a connected set of vehicles configured to move along a track for transportation of freight and/or passengers from one place to another. The train 110 may represent a freight train, monorail train, high-speed rail train, commuter train, tram, rubber-tired underground train, Maglev, or similar transport vehicle that travels along a railway and intersects a public thoroughfare. Data center 120 represents a centralized location for receiving train status information from multiple railway trains and also for forwarding train traffic information to subscribing devices 130*a*-130*c*. More specifically, subscribers 130*a*-130*c* represent vehicles, computing devices, railroad crossings, and/or communication channels registered to receive train traffic information from the train traffic advisor application as will be described in further detail below.

Figure 2:
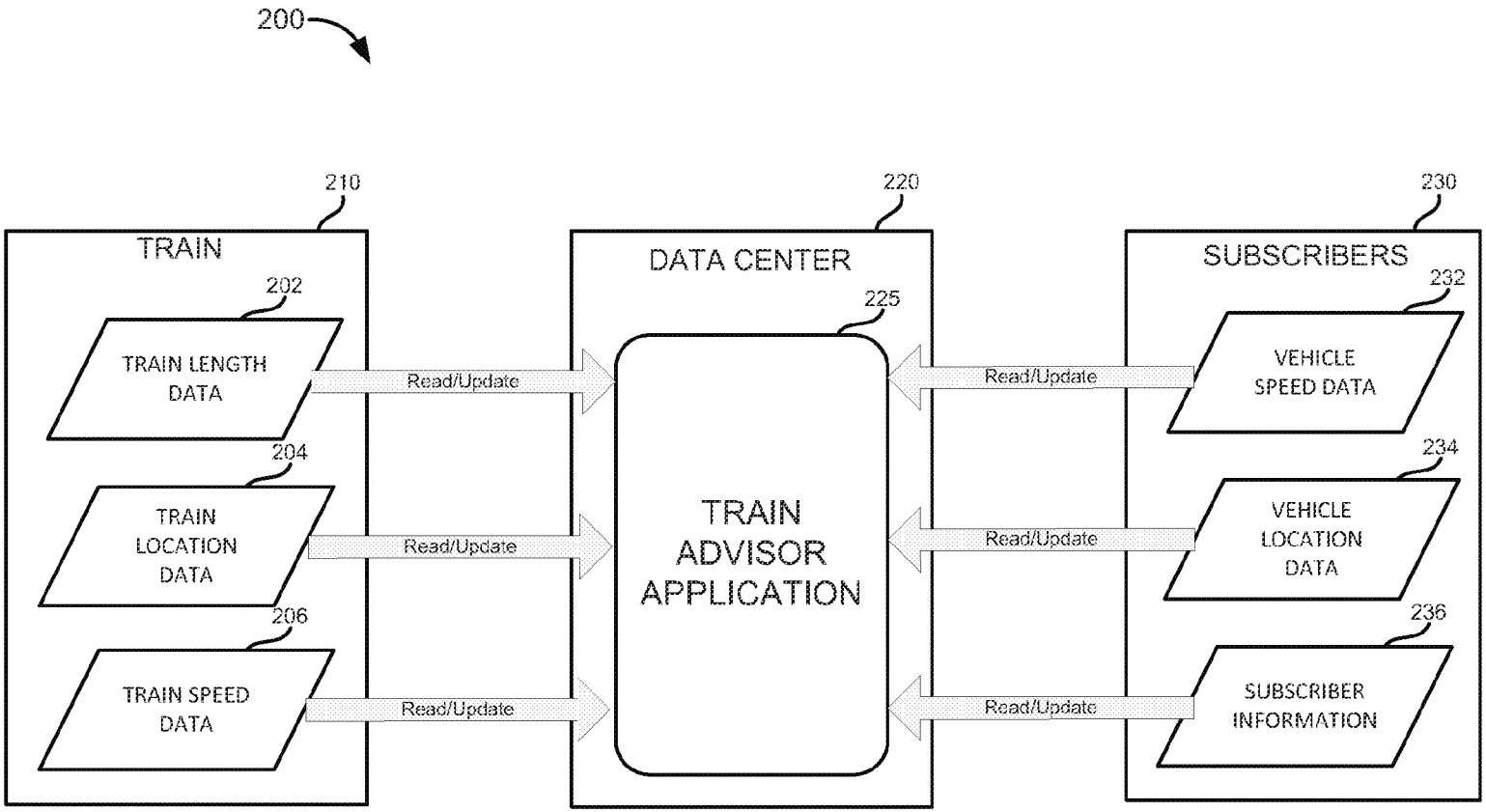
FIG. 2 is a simplified block diagram highlighting the communication and data exchange among the train, data center, and subscribers according to an example of the present invention.

FIG. 2 is a simplified block diagram highlighting the communication and data exchange among the train, data center, and subscribers according to an example of the present invention. As shown here, train and subscriber data is communicated between the train 210, data center 220, and subscribers 230. Specifically, data is read and updated continuously via the train advisor application 225 associated with the data center 220. According to one example, the train 210 is configured to transmit train length data 202, train location data 204, and train speed data 206. Train length data, which commonly varies per railroad train, represents the total length of the present train including all of the connected railroad cars (e.g., freight car or coach) and locomotive train if applicable. U.S. patent application number 2008/0243320, the content of which is incorporated by reference herein, discloses a method of measuring a train's length based on radio-ranging using radio or GPS devices attached to opposite ends of the train. Train location data represents the instantaneous position of the train along the railway (GPS data), while train speed represents the instantaneous or average velocity of the train (from speedometer or from GPS signals taken at regular intervals). The train may also be equipped with accelerometers configured to measure the train's instantaneous acceleration such that speed is inferred by the train advisor application. Alternatively, train acceleration could be inferred from the speed data, or both speed and acceleration information may be utilized to develop a more consistent and detailed analysis of the train travel status. Upon determination of the train length, that data, together with train location data 204 and train speed data 206 may be transmitted to the data center 210 via a telecommunication mechanism. These communication channels could be a smart phone using cellular networks, proprietary radio transmissions, telegraphic transmission or any other suitable mechanism or protocol capable of wirelessly transferring data from the train 210 to data center 210. In addition, the data center is also configured to receive continually updated subscriber information 236 relating to the set of subscriber vehicles/devices registered to receive train traffic information. The train traffic advisor application may utilize the speed/acceleration of the vehicle (vehicle speed data 232) and the instantaneous location of the vehicle (vehicle location data 234) to help infer the direction and travel route of a particular subscriber vehicle. The train status information (202, 204, and 206) and subscriber travel information (232, 234) is then analyzed by the train traffic advisor application in order to provide train traffic notifications and assist in travel route adjustment when necessary.

Figure 3:
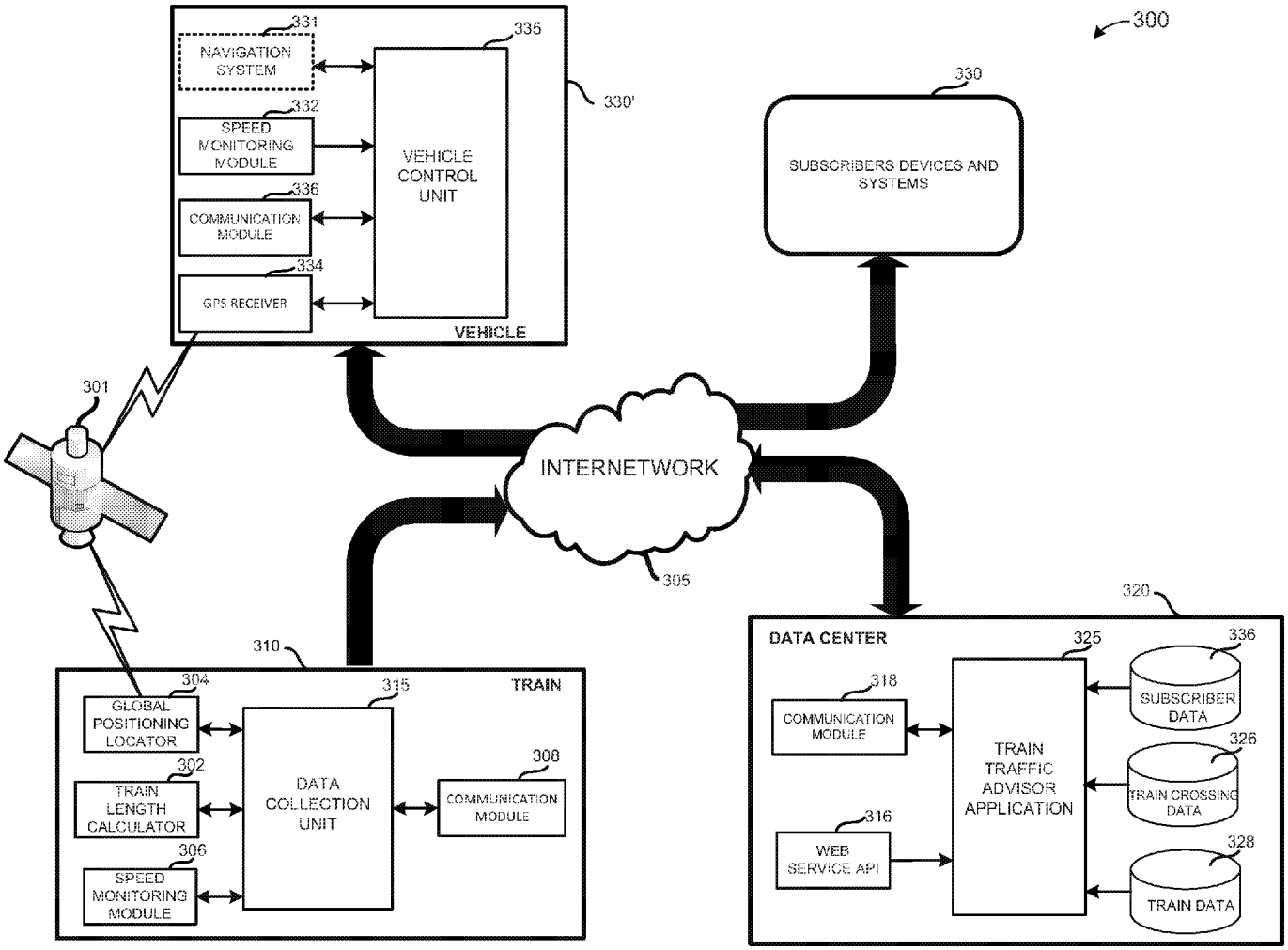
FIG. 3 is a simplified block diagram of the train traffic advising system in accordance with an example of the present invention.

FIG. 3 is a simplified block diagram of the train traffic advising system in accordance with an example of the present invention. As shown in here, the train traffic advisor system 300 includes a train, data center, vehicle, and subscriber devices. The train 310 includes a global positioning locator 304, a train length calculator 302, a speed monitoring module 306, a data collection unit 315, and a communication module 308. The global positioning locator represents a GPS unit for approximating the location of the train (longitude and latitude). In one example, approximating the location of the train is accomplished by receiving location information from a satellite (301). The train length calculator 302 is configured to estimate the length of the train based on manual entry from a user regarding the number and length of railroad cars, or automatically based on radio-ranging as described in the incorporated reference application. The speed monitoring unit is configured to approximate the instantaneous speed and/or acceleration of the train via the GPS data as will be appreciated by one skilled in the art. Data processing and collection unit 315 represents a central processing unit (CPU), microcontroller, microprocessor, or logic configured to execute programming instructions associated with the collection and processing of data relating to with train 310. According to one example, the GPS location data, the speed of the train, and the train length are acquired in an automated manner and transmitted over network 305 to the data center 320 via the communication module 308, which may represent a train radio or similar wireless data transmission device.

In accordance with an example of the present embodiment, the data center includes a communication module 318, a web service application programming interface (API) 316, a train traffic advisor application 325, and databases for storing train crossing data 326, subscriber data 336, and train status information 328. The communication module 318 represents a wireless communication means for transmitting and receiving data. Programming interface 316 represents a web service application programming interface or similar interface capable of being accessed securely over the internet or across the network. The train traffic advisor application 325 represents a processing unit or software application configured to analyze train status information 328 (e.g., train length, train speed/acceleration, train location) along with stored train crossing data 326 relating to the position of railroad crossings across a geographical area in order to compute train traffic information. More particularly, the data center 320 and advisor application 325 may collect train status information continuously and for a plurality of trains. In one instance, the train traffic information details the arrival time and clearance time for a particular train at a particular railroad crossing. The train traffic information pertaining to one or more trains is then communicated and/or broadcast to a vehicle subscriber 330' and/or other subscriber devices/systems 330 identified from the subscriber database 336.

The vehicle subscriber 330' may include a GPS receiver 334, a communication module 336, a speed monitoring module 332, navigation system 331, and a vehicle control unit 335. In the present example embodiment, the vehicle control unit 335 represents a central processor for the collection and processing of the instantaneous speed (via data returned from the speed monitor module 332) and GPS position (via positional data from the GPS receiver 334) of the vehicle 330'. This data may be utilized by the vehicle control unit 335 or the train advisor application 325 to derive the travel direction and possible route of the vehicle. Alternatively, an on-board navigation system 331 may be used to provide details of the vehicle's travel route.

Still further, the data center train traffic advisor application 325 may be configured to make the train traffic information available through multiple channels including a web service (available to subscribing organizations), and/or a synthesized voice radio broadcast that could supply the train railroad crossing information to FM channels—per geographical area. Moreover, the synthesized voice channel may be used in conjunction with an Interactive Voice Response (WR) computer telephony system to supply the train traffic information in a self-service manner. A third publication or advising scenario may involve the built-in navigational system 331 of a vehicle 330, automatically acquiring railroad crossing information via proprietary third-party channels. Or, alternatively, the in-vehicle telematics or navigational system 331 may directly acquire the train traffic information by accessing the data center's web service API 316. Depending on the driver's preferences and modalities of usage, the telematics system 331 may proactively advise the user—via voice or on the display screen—of the railroad crossings in the vicinity of the vehicle and a status thereof Alternatively, the driver of a vehicle may call an IVR unit using a portable electronic device (e.g., smartphone) and inquire about any railroad crossing within the vicinity and the estimated time of arrival of any trains going through these crossings. The IVR, through embedded voice menu options and/or a speech recognition subsystem for example, may retrieve the railroad crossing data and communicate it through synthesized speech to the caller. Another example may involve the caller device furnishing the GPS data and/or the instantaneous speed of the vehicle through a built-in GPS unit on the portable electronic device (e.g., smartphone, stand-alone GPS unit).

Also within in a web service scenario, a service provider (e.g., GM OnStar®) may retrieve the railroad crossing information for all the trains and all the railroad crossings in a particular region (e.g., west coast) on a regular basis. The train traffic information may then be stored in service provider's databases such that service provider subscribers may access this information through the train traffic advisor application hosted by the service provider. When a subscriber calls the service provider, the train traffic advisor application may the look up the subscriber's position, instantaneous speed, and travel direction (may be computed), and then advise the subscriber of any trains going through railroad crossings within the subscriber's travel route (based on computed present location and speed data).

Figure 4:
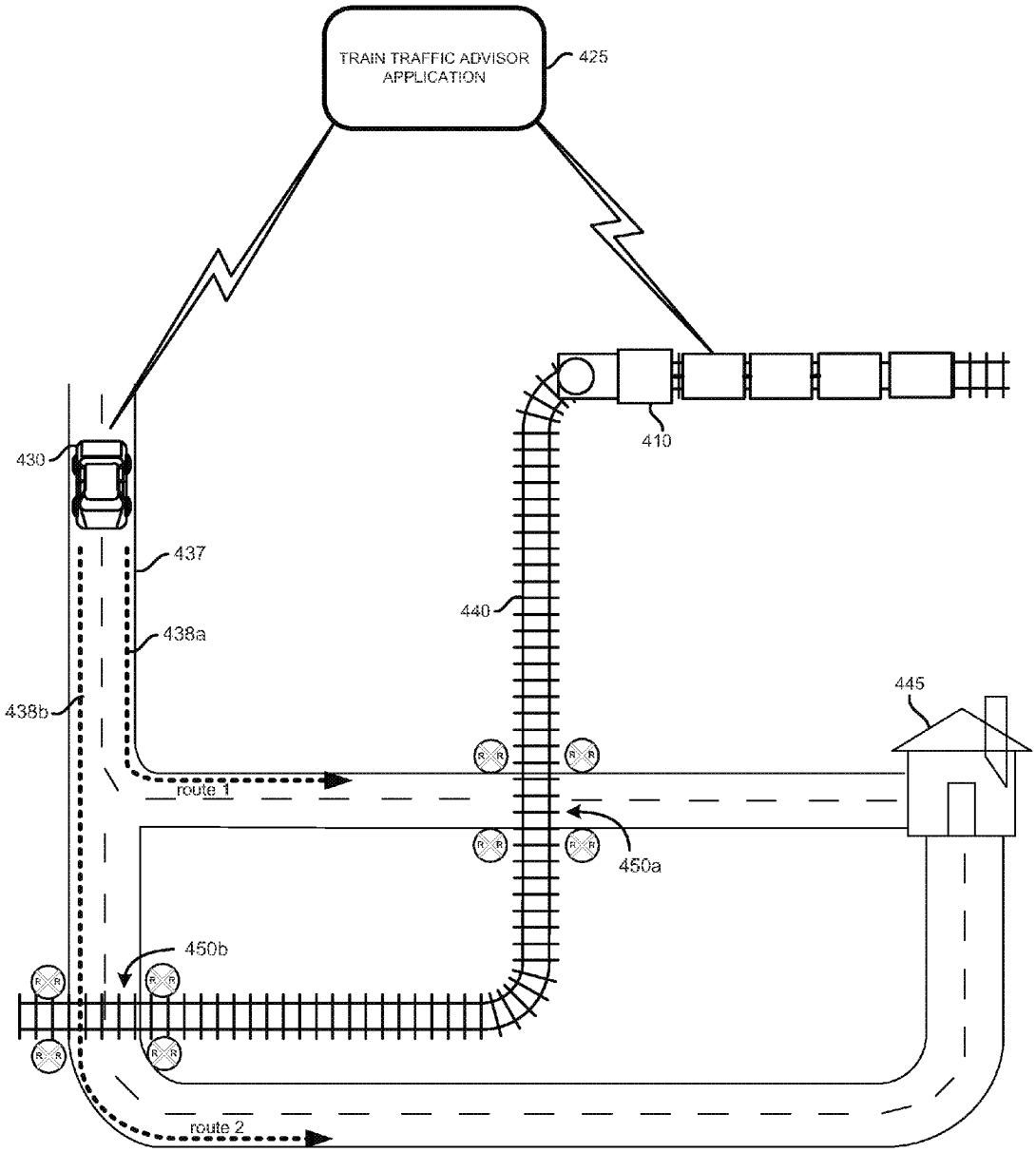
FIG. 4 is a simplified illustration of an operating environment involving the train traffic advising system according one example of the present invention.

FIG. 4 is a simplified illustration of an operating environment involving the train traffic advising system according to one example of the present invention. In the present example, an approaching train 410 and subscribing vehicle 430 travel within a common geographical area. As shown in FIG. 4, the subscribing vehicle 430 and train 410 travel in a south and south-east direction respectively. The subscribing vehicle 430 travels along a roadway or street 437 and may elect to take one of two travel routes 438*a* or 438*b* to reach destination 445. Here, the train 410 travels along a railway or railroad 440 that includes two railroad crossings 450*a* and 450*b*. In accordance with examples of the preset invention, the train traffic advisor application 425 is configured to calculate the arrival time and train clearance time (i.e., train traffic information) of train 410 at railroad crossings 450*a* and 450*b*. Moreover, the advisor application may also utilize subscriber travel data (e.g., location, speed, direction) and train status information (e.g., location, speed, and train length) to determine the optimal travel route for the subscribing vehicle 430. Here, the advisor application 425 may determine, based on the train traffic information and subscriber route data, that the subscribing vehicle 430 will arrive at the railroad crossing intersection 450*a* at the same time as train 410 and will thus be forced to wait for the train to clear railroad crossing 450*a*. However, it may be determined, based on the travel speed of train 410 and the velocity (speed and direction) of vehicle 430, that subscriber vehicle 430 will arrive at railroad crossing 450*b* a number of minutes prior to the computed arrival time of train 410 at railroad crossing 450*b*. Consequently, and in accordance with examples described herein, the train traffic advisor application 425 may advise the subscribing vehicle 430 to travel the longer secondary route 438*b* rather than the shorter first route 438*a* due to the arrival and clearance time of train 410 at railroad crossing 450*a*. For example, the train 410 may include twenty railroad cars and an approximate clearance time of eight minutes at railroad crossing 450*a*, while the difference in travel time (without train traffic) between the shorter first route 438*a* and longer second route 438*b* is only four minutes and thus the faster travel route to destination 445.

Figure 5:
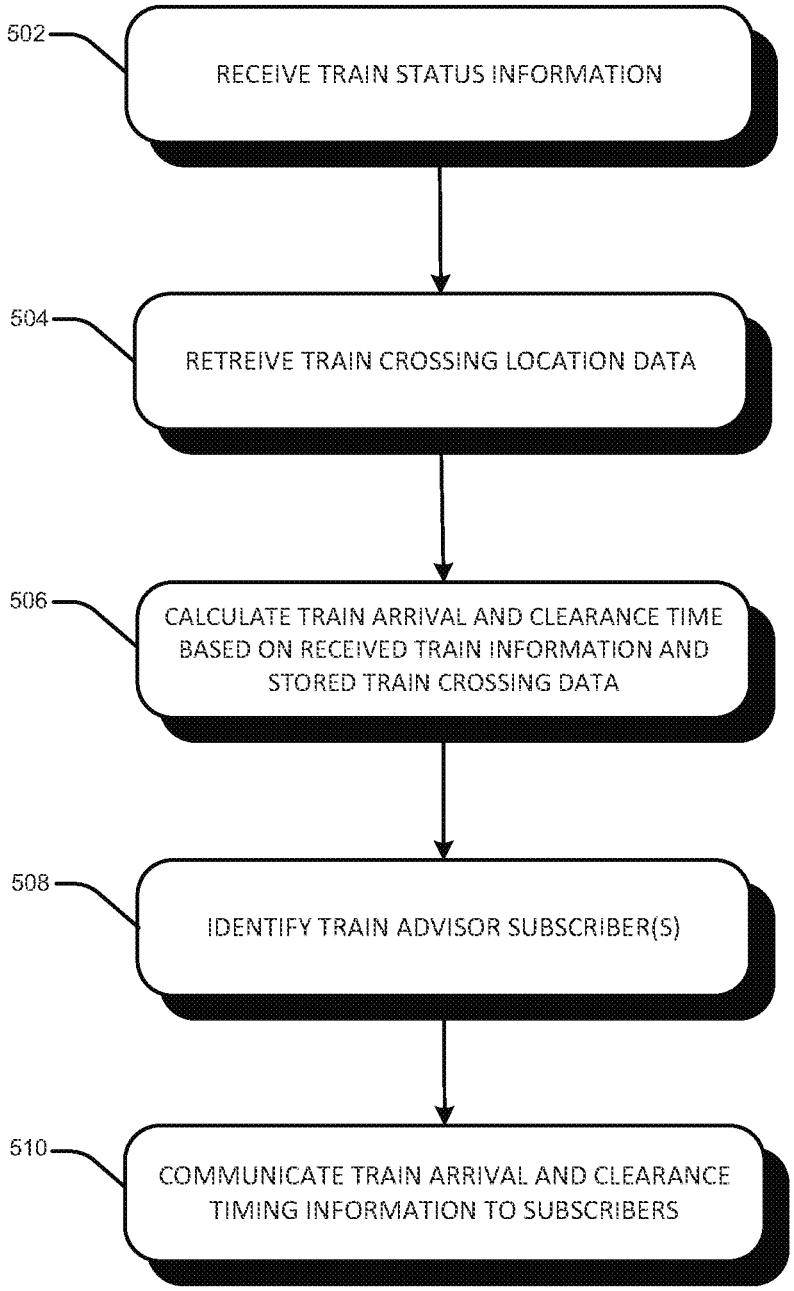
FIG. 5 is a simplified flow chart of the processing steps for providing train traffic information to subscribers in accordance with an example of the present invention.

FIG. 5 is a simplified flow chart of the processing steps for providing train traffic information to subscribers in accordance with an example of the present invention. In step 502, the data center train traffic advisor application receives train status information over the network. As described above, the train may be equipped with a GPS unit that transmits its location at regular intervals to the data center. During that transmission, the train may also send data relating to the instantaneous speed and length of the train. Alternatively, the average speed of a train may be determined from the GPS data by subtracting two consecutive longitude and latitude values from each other and dividing the result by the time interval between the reception of these two GPS data points, and the length of the train may be determined manually or automatically through radio-ranging. Still further, the speed, direction, and/or acceleration of the train (or vehicle) may be estimated by either the train, vehicle, or train traffic advisor application in accordance with examples of the present invention. Thereafter, in step 504, the advisor application retrieves stored train crossing location data for railroad crossings within the geographic area of the subject train. Given the instantaneous position of the train (encoded in the GPS data or other suitable data sent by the train), the instantaneous or average speed of the train, the length of the train, and the location of the known railroad crossings, an estimated arrival time for the train may be obtained in step 506. According to one example, the estimated train arrival and clearance time of one or more railroad crossings (i.e., next crossing, second crossing, all crossings in train path) may be calculated by subtracting the distance to the crossing from the current train location and dividing the resultant number by the instantaneous or average train speed. In step 508, one or more train traffic advisor subscribers are identified, and the train arrival and clearance time (i.e., train traffic information) at local railroad crossings is then communicated to the identified subscribers in step 510.

Figure 6:
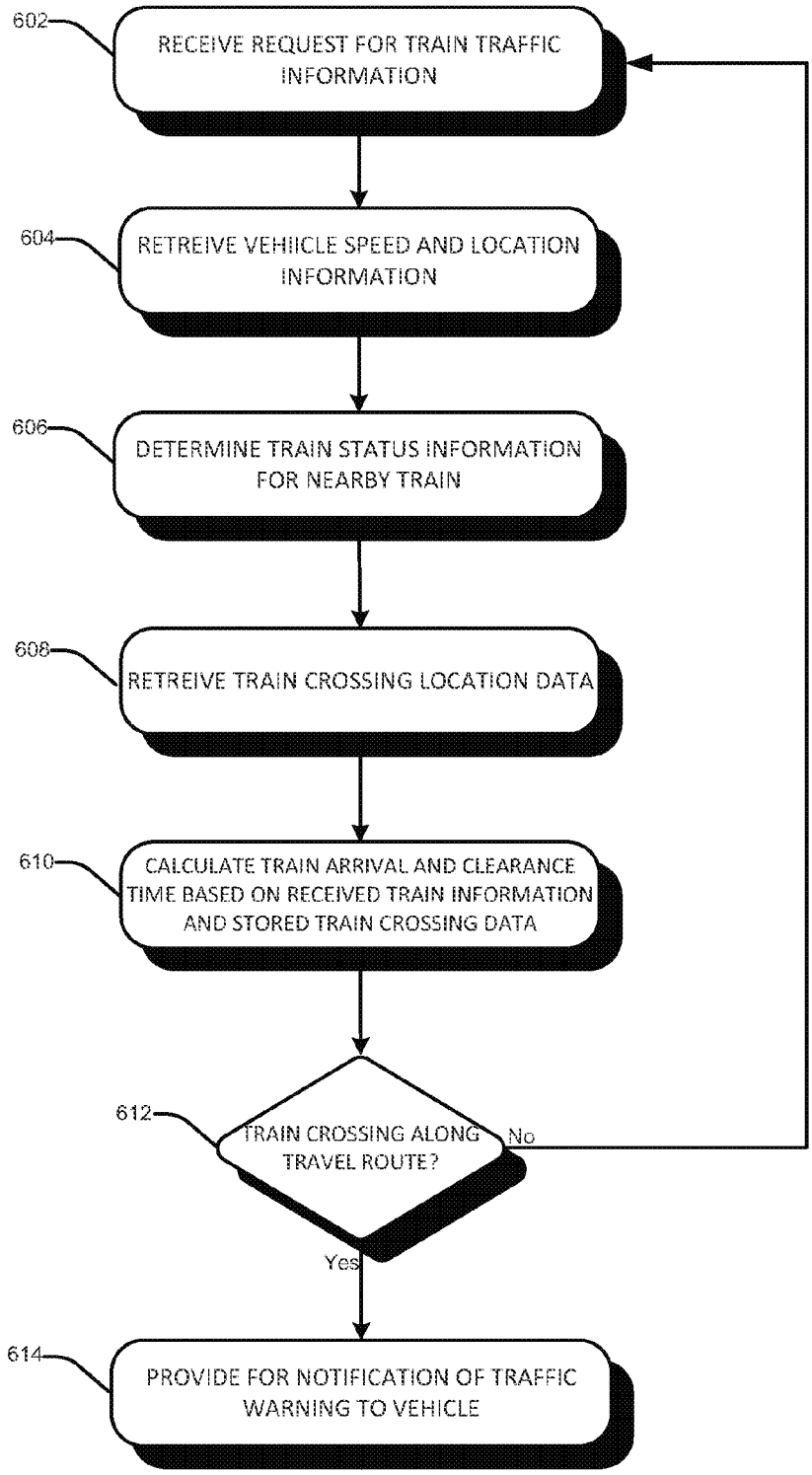
FIG. 6 is a simplified flow chart of the processing steps for providing train traffic guidance advice to a subscriber vehicle according to an example of the present invention.

FIG. 6 is a simplified flow chart of the processing steps for providing train traffic guidance advice to a subscriber vehicle according to an example of the present invention. In step 602, the train traffic advisor application receives a request for train traffic information from a subscribing user or vehicle (via an in-vehicle navigation/telematics unit or smartphone-based application for example). Next, in step 604, the train traffic advisor application retrieves the vehicle speed and location information from the subscribing or requesting user's vehicle. At least one nearby train is determined in step 606 along with the train status information including the train speed and length as described in the previous example embodiment. In step 608, the advisor application retrieves stored train crossing location data for railroad crossings within the geographic area of the subject train and requesting vehicle. Thereafter, in step 610, the arrival and clearing time of the nearest train at one railroad crossing (e.g., crossing nearest to subscriber) is then calculated based on the received train status information and the stored railroad train crossing location data. If a train crossing is determined to lie along the travel route (estimated or given) of the subscribing vehicle, then in step 614 a train traffic notification is provided to the requesting user via an in-vehicle GPS system or smartphone for example.

Example embodiments of the present invention provide a train traffic advisor system and method thereof. Moreover, many advantages are afforded by the train traffic advisor system according to embodiments of the present invention. For instance, the present system serves to ease the flow of traffic along roadways by publishing or otherwise making available train status information at a particular railroad crossing. Motorists, and particularly emergency and security vehicles operating in large cities, can thus prepare for any possible traffic congestion or delays caused by the arrival of a lengthy railway train at railroad crossing within the vehicle's travel path.

Furthermore, while the invention has been described with respect to example embodiments, one skilled in the art will recognize that numerous modifications are possible. For example, one possible modification is to add one additional radio transceiver that is suitably selected and installed on the train to broadcast synthesized voice messages on FM, AM, CB, and other frequencies from the train. The voice broadcast may state the length of the train, the estimated time it will take for that train to clear the nearest junction(s) or railroad crossing, and the location of the junction(s). This message may be repeated until updated by information regarding the length, speed, and position for the next junction(s) or until the train has cleared that particular crossing. The frequencies of these public messages may be published and publically available so that a driver may hear these messages (e.g., via a radio receiver unit) and make travel route decisions in addition to aiding in the safety of pedestrians and drivers who cross these junctions. In such a configuration, the data processing and collection unit of the train may be configured to also compute, based on the current GPS data (or accelerometer and/or encoder data) as well as internal maps of the railroad crossings of the United States, the nearest train junctions and the estimated time of arrival at these crossing. This computation may be accomplished via comparison of the real-time position of the train with geo-spatial maps that are stored (and updated) and available to the train's data processing unit. In addition to the data processing and collect unit, a software module may be included within the train to transform the data into synthesized speech and to prepare and execute a radio-broadcast schedule.

Still further, the train could run a web server and publish a web services API so that individual agents could then program to that API and get train status information directly from the train. These agents could be embedded kiosk-like systems attached to the existing railroad crossings. In this manner, intelligent railroad crossings could inform others about the estimated time of arrival for upcoming trains and the estimated length of time it will take the train to clear the crossing. In this scenario, the information could be delivered to the vehicles via short range CB, or FM channels, or to a subscribing user's portable electronic device (e.g., cell phone) via a text message from the intelligent railroad crossing.

Moreover, examples of the present invention may implemented for ships, boats or similar watercraft vehicles, for advising subscribers with respect to the estimated arrival and clearance time of the watercraft vehicle at nearby suspension bridges. Thus, although the invention has been described with respect to exemplary embodiments, it will be appreciated that the invention is intended to cover all modifications and equivalents within the scope of the following claims.

What is claimed is:

1. A method for train traffic advising including a data center and network, the method comprising:

receiving, at a train traffic advisor application hosted by the data center, train status information associated with at least one train;

receiving, at the data center, a number of subscribers' travel information from a number of subscribing devices associated with the subscribers' vehicles, the travel information comprising a location, speed, and direction of a vehicle associated with the subscriber;

retrieving, via the train advisor application, train crossing location data stored in a database;

calculating, via the train advisor application, train traffic information associated with the at least one train based on the received train status information and the stored train crossing location data;

identifying, via the train advisor application, a number of the subscribing devices registered to receive information from the train advisor application; and communicating, via the train advisor application, the train traffic information to at least one of the subscribing devices associated with a subscriber's vehicle.

2. The method of claim 1, wherein the train status information includes the length of the train, the speed of the strain, and current position of the train.

3. The method of claim 2, wherein step of calculating the railroad crossing information further comprises:

determining, via the train advisor application, a train arrival time and train clearance time associated with at least one railroad crossing based on the length of the train, the speed of the train, and the current position of the train.

4. The method of claim 3, further comprising:

broadcasting the calculated train arrival time and train clearance time to the plurality of subscribing devices.

5. The method of claim 4, wherein the train arrival time and the train clearance time are broadcast publically over a short-range radio channel.

6. The method of claim 4, wherein the train arrival time and train clearance time are retrieved via an on-board vehicle navigation system.

7. The method of claim 1, further comprising:

providing, via the train traffic advisor application, for notification to the subscriber device if a train is determined to cross a path of the subscriber vehicle based on the subscriber travel information and the railroad crossing information associated with the train.

8. A train traffic advising system comprising:

a network;

a plurality of subscribing devices;

a data center coupled to the network and including a train traffic advisor application and a database for storing train crossing location data; and at least one train having an on-board train processing unit configured to collect train status information including a length of the train, a location of the train, and an average speed of the train, wherein the train processing unit is further configured to transmit the train information over the network to the data center;

wherein the train traffic advisor module is configured to calculate railroad crossing information based on the train status information and the stored train crossing location data, wherein the data center receives subscriber travel information from a plurality of subscriber devices associated with a number or subscribers' vehicles; the travel information comprising the location, speed, and direction of the subscribers' vehicles; and wherein the railroad crossing information is communicated externally over the network to the at least one identified subscriber device.

9. The system of claim 8, wherein the train status information includes the length of the train, the speed of the strain, and current position of the train.

10. The system of claim 9, wherein a train arrival time and train clearance time associated with at least one railroad crossing is calculated based on the length of the train, the speed of the train, and the current position of the train.

11. The system of claim 10, wherein the calculated train arrival time and train clearance time are broadcast to the plurality of subscribing devices.

12. The system of claim 11, wherein the train arrival time and the train clearance time are broadcast publically over a short-range radio channel.

13. The system of claim 11, wherein the train arrival time and train clearance time are retrieved via an on-board vehicle navigation system.

14. The system of claim 8, wherein the data center provides a notification to the subscriber vehicle if at least one train is determined to cross a path of the subscriber vehicle based on the subscriber travel information and the railroad crossing information associated with the at least one train.

15. A method for train traffic advising including a data center and network, the method comprising:

a train and an on-board data collection unit for said train for:

collecting train status information including the length of the train, the location of the train, and an average speed of the train; and transmitting the train status information over a network;

a train traffic advising application for:

receiving train status information from the train data collection unit;

retrieving stored train crossing location data from a database;

calculating a train arrival time and train clearance time based on the received train status information and the train crossing location data; and broadcasting the calculated train arrival time and train clearance time to at least one external system or device;

receiving subscriber travel information including the location, speed, and direction of a subscriber vehicle; and providing for notification to the subscriber vehicle if a train is determined to cross a path of the subscriber vehicle based on the subscriber travel information and the railroad crossing information associated with at least one train.

16. The method of claim 15, further comprising:

broadcasting the calculated train arrival time and train clearance time to the plurality of subscribing devices.

17. The method of claim 15, wherein the train arrival time and the train clearance time are broadcast publically over a short-range radio channel.

18. The method of claim 15, wherein the train arrival time and train clearance time are retrieved via an on-board vehicle navigation system.

* * * * *

UNITED STATES PATENT AND TRADEMARK OFFICE

CERTIFICATE OF CORRECTION

PATENT NO. : 8,838,301 B2
APPLICATION NO. : 13/456784
DATED : September 16, 2014
INVENTOR(S) : Babak Makkinejad It is certified that error appears in the above-identified patent and that said Letters Patent is hereby corrected as shown below:

IN THE CLAIMS

In column 8, line 17, in Claim 2, delete “strain,” and insert -- train, --, therefor.

In column 8, line 36, in Claim 7, before “notification” delete “for”.

In column 8, line 59, in Claim 8, delete “or” and insert -- of --, therefor.

In column 8, line 66, in Claim 9, delete “strain,” and insert -- train, --, therefor.

In column 10, line 7, in Claim 15, after “data;” delete “and”.

Signed and Sealed this
Twentieth Day of October, 2015

Michelle K. Lee

Michelle K. Lee
*Director of the United States Patent and Trademark Office*